US010899372B2

(12) United States Patent
Taga et al.

(10) Patent No.: US 10,899,372 B2
(45) Date of Patent: Jan. 26, 2021

(54) RAILCAR BOGIE

(71) Applicant: KAWASAKI JUKOGYO KABUSHIKI KAISHA, Kobe (JP)

(72) Inventors: Yukitaka Taga, Kobe (JP); Fumikazu Kounoike, Kakogawa (JP); Yukihiro Sano, Kobe (JP); Takaya Ono, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 261 days.

(21) Appl. No.: 16/065,823

(22) PCT Filed: Nov. 29, 2016

(86) PCT No.: PCT/JP2016/005005

§ 371 (c)(1),
(2) Date: Jun. 25, 2018

(87) PCT Pub. No.: WO2017/110045

PCT Pub. Date: Jun. 29, 2017

(65) Prior Publication Data

US 2019/0016352 A1 Jan. 17, 2019

(30) Foreign Application Priority Data

Dec. 25, 2015 (JP) ..... 2015-252987

(51) Int. Cl.

| | |
|---|---|
| ***B61F 5/30*** | (2006.01) |
| ***B61F 5/00*** | (2006.01) |
| ***B61F 5/50*** | (2006.01) |

(52) U.S. Cl.

CPC ..... *B61F 5/302* (2013.01); *B61F 5/00* (2013.01); *B61F 5/30* (2013.01); *B61F 5/50* (2013.01)

(58) Field of Classification Search

CPC ..... B61F 3/00; B61F 5/00; B61F 5/02; B61F 5/08; B61F 5/26; B61F 5/28; B61F 5/30; B61F 5/50

See application file for complete search history.

(56) References Cited

U.S. PATENT DOCUMENTS

| | | | |
|---|---|---|---|
| 2006/0065153 | A1 | 3/2006 | Watanabe et al. |
| 2011/0253004 | A1 | 10/2011 | Nishimura et al. |

(Continued)

FOREIGN PATENT DOCUMENTS

| | | | |
|---|---|---|---|
| CN | 1754732 | A | 4/2006 |
| CN | 101956779 | A | 1/2011 |
| CN | 104870292 | A | 8/2015 |

(Continued)

*Primary Examiner* — Robert J McCarry, Jr.
(74) *Attorney, Agent, or Firm* — Oliff PLC

(57) ABSTRACT

A railcar bogie includes: a cross beam supporting a carbody of a railcar; an axle box including a bearing accommodating portion accommodating a bearing rotatably supporting a wheelset; a plate spring extending in a car longitudinal direction while supporting a car width direction end portion of the cross beam; and a receiving member provided above the axle box and supporting a car longitudinal direction end portion of the plate spring, an attachment hole being formed at a car longitudinal direction outside portion of the receiving member, a lifting fitting used to lift the bogie being attached to the attachment hole.

17 Claims, 4 Drawing Sheets

(56) References Cited

U.S. PATENT DOCUMENTS

| | | | |
|---|---|---|---|
| 2014/0137765 | A1 | 5/2014 | Nishimura et al. |
| 2015/0353105 | A1 | 12/2015 | Nishimura et al. |

FOREIGN PATENT DOCUMENTS

| | | | | | |
|---|---|---|---|---|---|
| JP | 2003-175822 | A | | 6/2003 | |
| JP | 2006-096137 | A | | 4/2006 | |
| JP | 2010-184684 | A | | 8/2010 | |
| JP | 2011-020585 | | * | 2/2011 | ..... B61F 5/10 |
| JP | 2011-020585 | A | | 2/2011 | |
| JP | 2014-037191 | A | | 2/2014 | |
| JP | 5442167 | B2 | | 3/2014 | |
| JP | 2014-133481 | | * | 7/2014 | ..... B61F 5/26 |
| JP | 2014-133481 | A | | 7/2014 | |

* cited by examiner

RAILCAR BOGIE

TECHNICAL FIELD

The present invention relates to a railcar bogie, and particularly to a railcar bogie which can be lifted by a crane or the like.

BACKGROUND ART

In a railcar bogie, an axle box accommodating a bearing rotatably supporting a wheelset is supported by a bogie frame through an axle box suspension. For example, in PTL 1, a bogie frame includes a pair of side sills extending in a car longitudinal direction and a cross beam connecting the pair of side sills in a car width direction, and an axle box suspension (axle spring) connects an axle box and the side sill of the bogie frame. PTL 2 proposes a bogie including: a bogie frame from which side sills are omitted; and plate springs each of which is long in a car longitudinal direction.

When assembling a bogie and a carbody, the bogie is lifted by a crane in some cases. In conventional cases, when lifting the bogie, a hook of the crane is attached to an axle or an axle box through a lifting rope.

CITATION LIST

Patent Literature

PTL 1: Japanese Laid-Open Patent Application Publication No. 2014-37191

PTL 2: Japanese Patent No. 5442167

SUMMARY OF INVENTION

Technical Problem

However, there is a possibility that when attaching the lifting rope to the axle or the axle box, the rope interferes with and is hooked to a wheel, an axle spring, or the like depending on a lifting angle of the rope. Therefore, to prevent the hooking of the lifting rope, an appropriate lifting position needs to be set in the bogie.

An object of the present invention is to realize lifting of a bogie including a plate spring while preventing a lifting rope and a component of the bogie from interfering with each other.

Solution to Problem

A railcar bogie according to one aspect of the present invention includes: a cross beam supporting a carbody of a railcar; an axle box including a bearing accommodating portion accommodating a bearing rotatably supporting a wheelset; a plate spring extending in a car longitudinal direction while supporting a car width direction end portion of the cross beam; and a receiving member provided above the axle box and supporting a car longitudinal direction end portion of the plate spring, an attachment hole being formed at a car longitudinal direction outside portion of the receiving member, a lifting fitting used to lift the bogie being attached to the attachment hole.

According to the above configuration, the lifting fitting is attached to the car longitudinal direction outside portion of the receiving member provided above the axle box. Therefore, when lifting the bogie including the plate spring, a lifting rope attached to the lifting fitting can be prevented from interfering with and being hooked to a component, such as a wheelset or a plate spring, of the bogie. On this account, the bogie including the plate spring can be lifted while preventing the lifting rope and the component of the bogie from interfering with each other.

Advantageous Effects of Invention

According to the present invention, the bogie including the plate spring can be lifted while preventing the lifting rope and a component of the bogie from interfering with each other.

DESCRIPTION OF EMBODIMENTS

Figure 1:
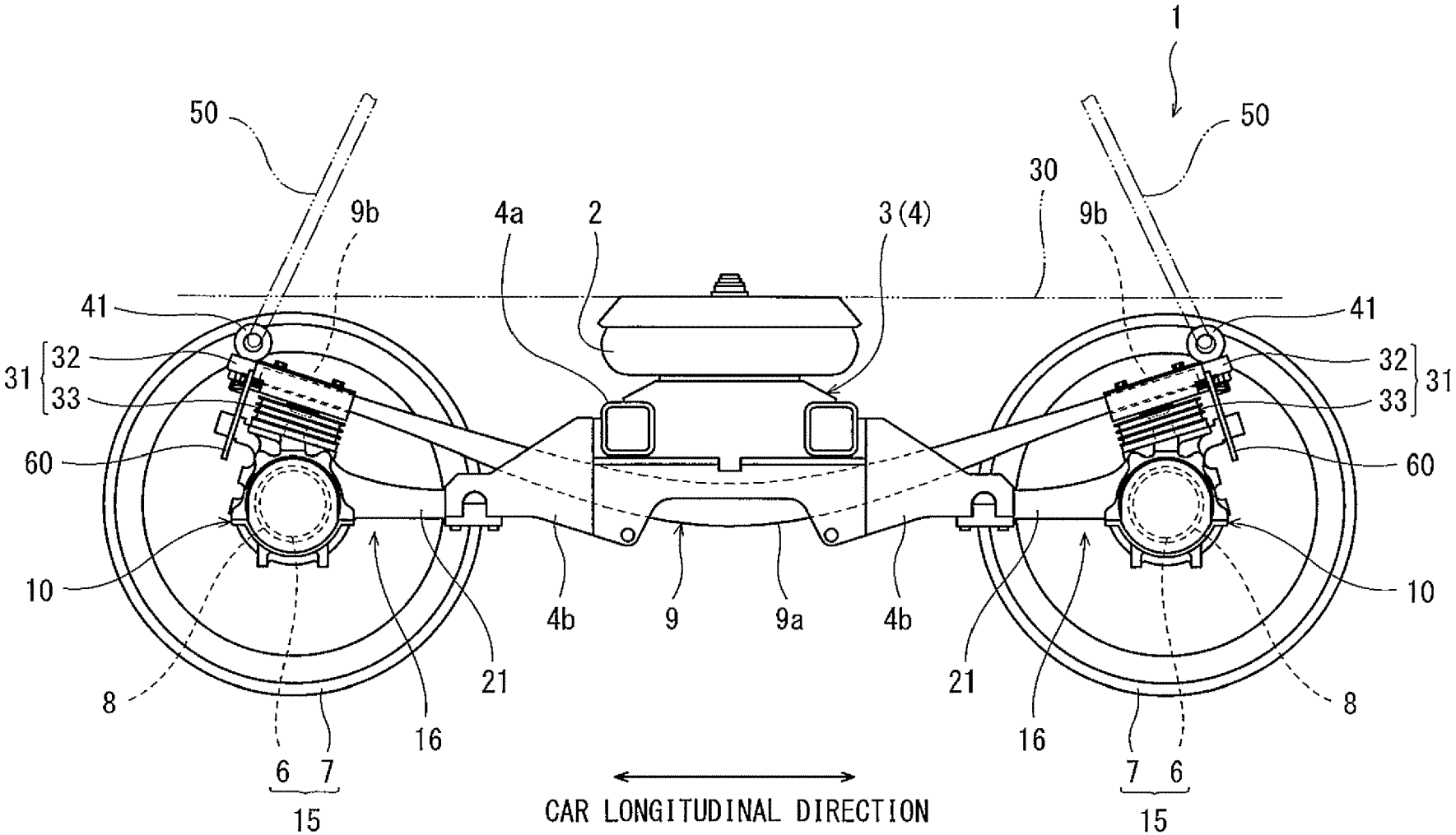
FIG. 1 is a side view of a railcar bogie according to an embodiment.

Hereinafter, an embodiment will be explained with reference to the drawings. In the drawings, the same reference signs are used for the same or corresponding components, and a repetition of the same explanation is avoided.

FIG. 1 is a side view of a railcar bogie 1 according to the embodiment. As shown in FIG. 1, the railcar bogie (hereinafter referred to as a "bogie") 1 includes a bogie frame 3 configured to support a carbody 30 through an air spring 2. The bogie frame 3 includes a cross beam 4 extending in a car width direction at a car longitudinal direction middle of the bogie 1. However, unlike the configuration of a conventional bogie frame, the bogie frame 3 does not include side sills extending in a car longitudinal direction from both respective car width direction end portions 4*a* of the cross beam 4.

Axles 6 each extending in the car width direction are arranged at both respective car longitudinal direction sides of the cross beam 4. Wheels 7 are press-fitted to both respective car width direction sides of each of the axles 6. The axle 6 and the wheels 7 constitute a wheelset 15. A pair of wheelsets 15 provided at the bogie 1 are arranged at both respective car longitudinal direction sides of the cross beam 4 so as to be spaced apart from each other. Bearings 8 rotatably supporting the wheels 7 are provided at both respective car width direction end portions of each axle 6 so as to be located outside the wheels 7 in the car width direction. The bearings 8 are accommodated in respective axle boxes 10.

Each of the axle boxes 10 is elastically coupled to the cross beam 4 of the bogie frame 3 through a corresponding axle box suspension 16. The axle box suspension 16 includes an axle beam 21 coupling the axle box 10 and the cross beam 4 in the car longitudinal direction. The axle beam 21 is formed integrally with the axle box 10 and extends from the axle box 10 toward the cross beam 4 in the car longitudinal direction. A tubular portion 21*a* (see FIG. 2) that is open at both car width direction sides is formed at a tip end of the axle beam 21. The tubular portion 21*a* is elastically coupled to a receiving seat 4*b* through a rubber bushing and a core rod (not shown), the receiving seat 4*b* being provided at the car width direction end portion 4*a* of the cross beam 4.

Each of plate springs 9 extends between the axle box 10 and the cross beam 4 in the car longitudinal direction. Car longitudinal direction middle portions 9*a* of the plate springs 9 support the respective car width direction end portions 4*a* of the cross beam 4 from below, and both car longitudinal direction end portions 9*b* of each of the plate springs 9 are indirectly supported by the respective axle boxes 10. To be specific, the plate spring 9 has both the function of a primary suspension and the function of a conventional side sill.

Both car longitudinal direction end portions 9*b* of each of the plate springs 9 are supported by the respective axle boxes 10 through respective supporting members 31. Each of the supporting members 31 is provided at an upper portion of the axle box 10. The supporting member 31 includes a receiving member 32 and a vibrationproof rubber unit 33. The receiving member 32 supports the car longitudinal direction end portion 9*b* of the plate spring 9 from below and is provided above the axle box 10 through the vibrationproof rubber unit 33. The receiving member 32 is formed by a metal material and has a substantially rectangular shape in a plan view.

The vibrationproof rubber unit 33 is substantially columnar and is inserted between the axle box 10 and the receiving member 32. The vibrationproof rubber unit 33 is constituted by a plurality of rubber plates 33*a* and a plurality of metal plates 33*b* interposed among the plurality of rubber plates 33*a* (see FIG. 2). An upper surface of the vibrationproof rubber unit 33 is inclined obliquely downward toward a middle side in the car longitudinal direction. It should be noted that the upper surface of the vibrationproof rubber unit 33 does not have to be inclined as long as the upper surface of the vibrationproof rubber unit 33 is substantially parallel to a lower surface 9*c* of the car longitudinal direction end portion 9*b* of the plate spring 9.

Next, the configuration for lifting the bogie 1 by a crane will be explained.

Figure 2:
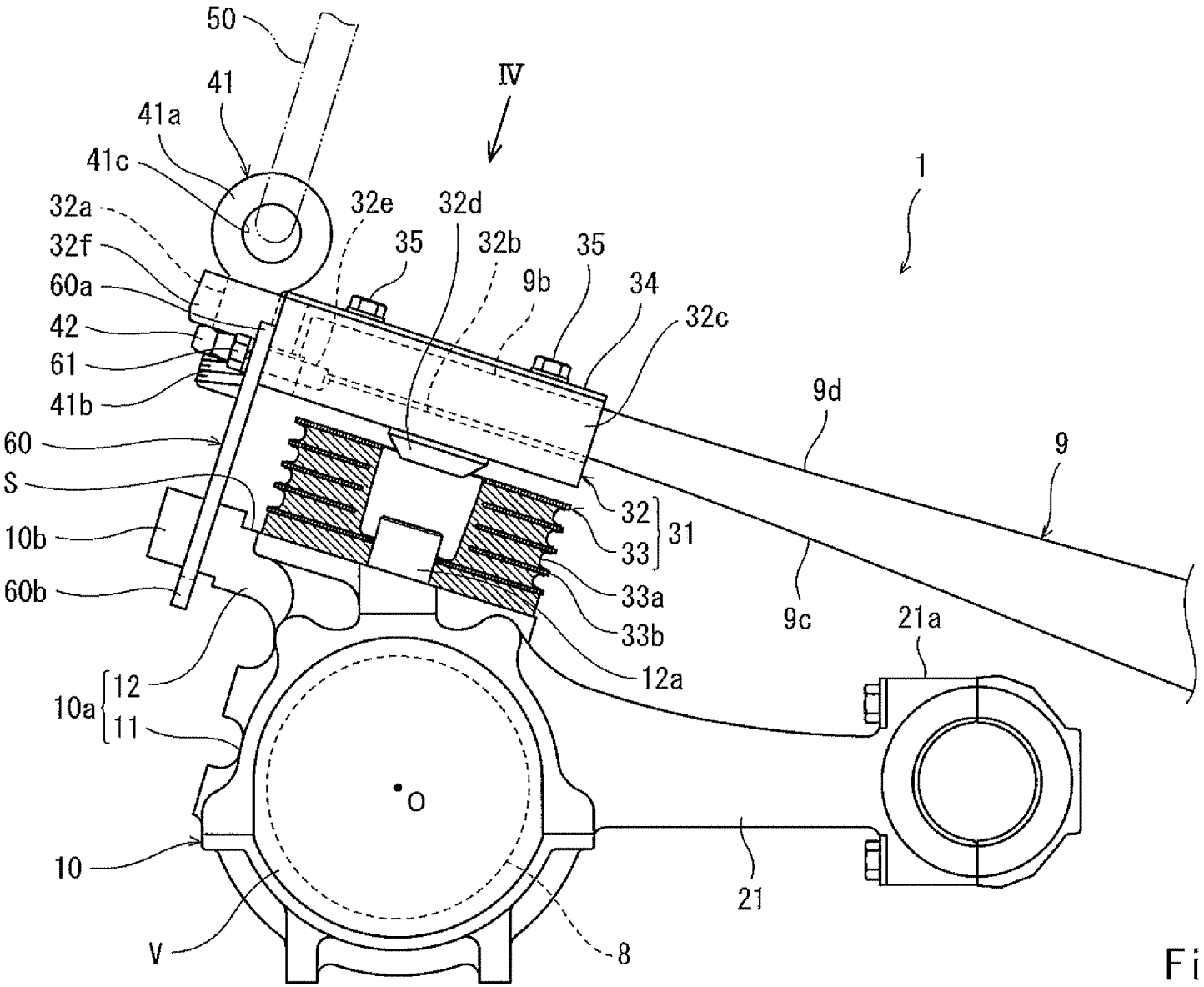
FIG. 2 is a side view of major components of the bogie shown in FIG. 1.

FIG. 2 is a side view of major components of the bogie 1 shown in FIG. 1. As shown in FIG. 2, the axle box 10 includes: a bearing accommodating portion 10*a* accommodating the bearing 8; and a projecting portion 10*b* projecting from the bearing accommodating portion 10*a* outward in the car longitudinal direction. The bearing accommodating portion 10*a* includes an axle box main body 11 and a spring seat 12 formed integrally with the axle box main body 11 and indirectly supporting the plate spring 9.

The axle box main body 11 includes an accommodating space V accommodating the bearing 8 and having a completely circular column shape. The axle box main body 11 is formed integrally with the axle beam 21. An upper surface S of the spring seat 12 is inclined obliquely downward toward a middle side in the car longitudinal direction and is substantially parallel to the lower surface 9*c* of the plate spring 9. It should be noted that a liner for adjusting a wheel load of the wheel 7 may be interposed between the spring seat 12 and the vibrationproof rubber unit 33. The spring seat 12 includes a substantially columnar protruding portion 12*a* projecting upward from the upper surface S, and the protruding portion 12*a* is inserted into a lower through hole 33*c* (see FIG. 3) of the vibrationproof rubber unit 33.

A hooking member 60 is a plate member (see FIG. 4) made of metal and having a substantially U shape. An upper end portion of the hooking member 60 is fixed to the receiving member 32 by fastening members (for example, bolts) 61. When lifting the bogie 1 by a crane, the hooking member 60 and the projecting portion 10*b* of the axle box 10 are hooked to each other. With this, the entire bogie 1 can be lifted. A detailed configuration of the hooking member 60 will be described later.

A lifting fitting 41 is, for example, an eye bolt and is attached to an attachment hole 32*a* formed at a car longitudinal direction end portion of the receiving member 32. The eye bolt 41 includes an annular attaching portion 41*a* and a threaded portion 41*b*, and the attaching portion 41*a* includes a hole 41*c* through which a lifting rope 50 is inserted. It should be noted that the configuration of the eye bolt 41 is not limited to this. For example, in the eye bolt 41, a base portion including a flat seat surface contacting an upper surface of the receiving member 32 may be formed between the attaching portion 41*a* and the threaded portion 41*b*.

From a lower surface side of the receiving member 32, a nut 42 is threadedly engaged with the threaded portion 41*b* penetrating the attachment hole 32*a*. With this, the eye bolt 41 is fixed to the attachment hole 32*a*. At this time, the attaching portion 41*a* of the eye bolt 41 is located higher than an upper surface 9*d* of the plate spring 9. It should be noted that the attachment hole 32*a* is a through hole but may be subjected to tapping.

The eye bolts 41 are fixed to the respective receiving members 32 located at front-left, front-right, rear-left, and rear-right portions of the bogie 1. To be specific, four eye bolts 41 are provided for each bogie, and the lifting ropes 50 are attached to the respective eye bolts 41. Therefore, the bogie 1 is lifted by using four ropes 50. A lifting angle of the rope 50 when lifting the bogie 1 is set to a value normally used in slinging work performed by a crane. Specifically, the lifting angle of the rope 50 is set to less than 90°, preferably 60° or less. It should be noted that the eye bolts 41 and the nuts 42 are attached to the attachment holes 32*a* only when lifting the bogie, and the eye bolts 41 and the nuts 42 are detached from the bogie 1 during normal traveling.

Figure 3:
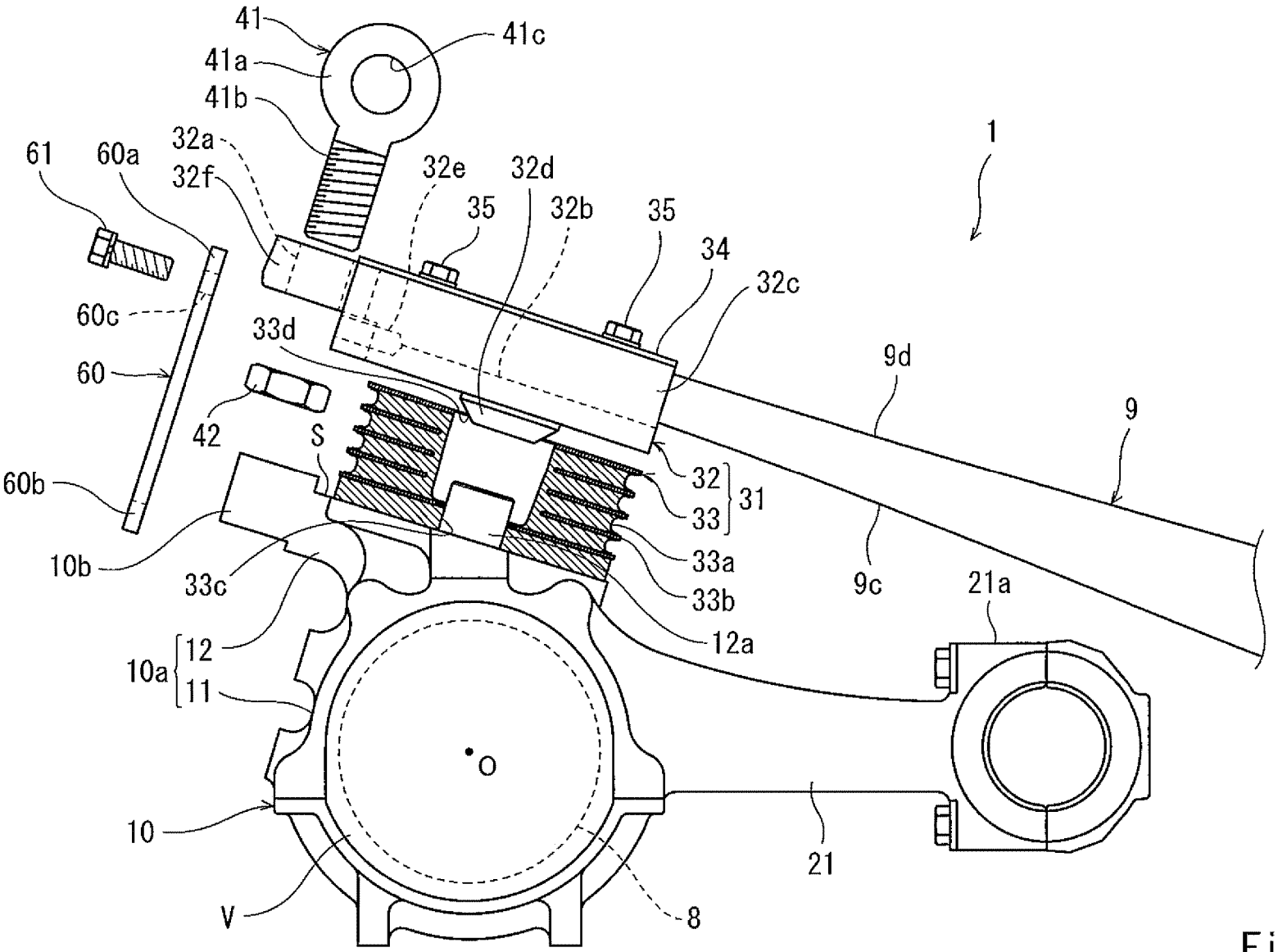
FIG. 3 is an exploded side view of major components of the bogie shown in FIG. 2.
Figure 4:
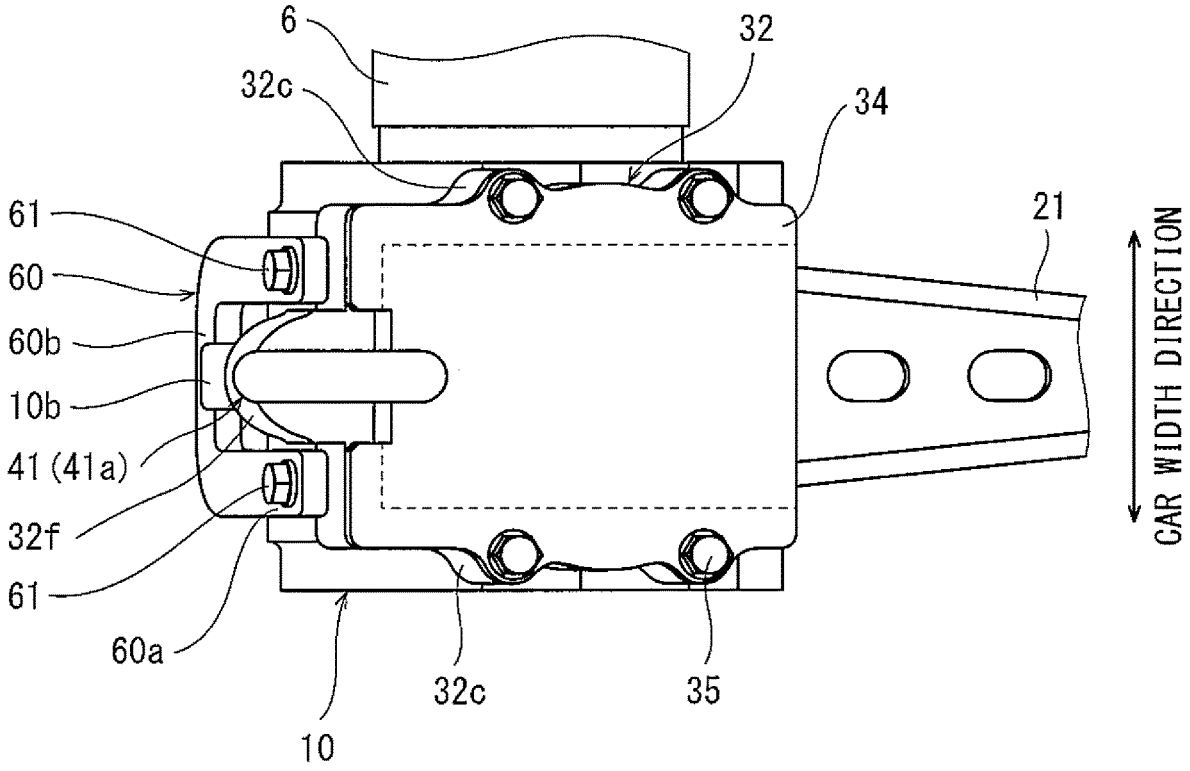
FIG. 4 is a diagram when viewed from a direction indicated by an arrow IV shown in FIG. 2.

FIG. 3 is an exploded side view of major components of the bogie 1 shown in FIG. 2. FIG. 4 is a diagram when viewed from a direction indicated by an arrow IV shown in FIG. 2. As shown in FIGS. 2 to 4, the receiving member 32 includes: a bottom wall portion 32*b* supporting the lower surface 9*c* of the plate spring 9; and a pair of side wall portions 32*c* projecting upward from both respective car width direction end portions of the bottom wall portion 32*b*. The bottom wall portion 32*b* includes a projecting portion 32*d* projecting downward from a part of a lower surface of the bottom wall portion 32*b*, and the projecting portion 32*d* is inserted into an upper through hole 33*d* of the vibrationproof rubber unit 33 (see FIG. 3).

The car longitudinal direction end portion 9*b* of the plate spring 9 is surrounded by the bottom wall portion 32*b*, the pair of side wall portions 32*c*, and a cover member 34. Each of the pair of side wall portions 32*c* includes a threaded through hole 32*e* subjected to tapping, and the bolt 61 is threadedly engaged with the threaded through hole 32*e* from an outer side in the car longitudinal direction.

Further, the receiving member 32 includes an outer wall portion 32*f* provided at a car longitudinal direction end portion of the bottom wall portion 32*b*. The outer wall portion 32*f* includes the attachment hole 32*a* formed between the threaded through holes 32*e*, and the eye bolt 41 is attached to the attachment hole 32*a* as described above. The outer wall portion 32*f* is located higher than the bottom wall portion 32*b* and is opposed to the projecting portion 10*b* of the axle box 10 in an upward/downward direction.

The hooking member 60 includes a fixed portion 60*a* and a hooking portion 60*b*. The fixed portion 60*a* is fixed to the receiving member 32. The fixed portion 60*a* corresponds to an upper end portion of the hooking member 60 having the substantially U shape, and the hooking portion 60*b* corresponds to a lower end portion of the hooking member 60. The fixed portion 60*a* includes through holes 60*c*, through which the bolts 61 penetrate, at positions opposed to the respective threaded through holes 32*e*. The fixed portion 60*a* is fixed to the side wall portions 32*c* by the bolts 61. The hooking portion 60*b* is provided lower than the fixed portion 60*a* and is opposed to the projecting portion 10*b* of the axle box 10 from below with a predetermined interval.

In the present embodiment, the hooking members 60 are fixed to the receiving members 32 at all times. However, the hooking members 60 may be attached to the bogie 1 only when lifting the bogie.

When the crane is driven to lift the receiving member 32 upward by tensile force of the lifting rope 50, the hooking portion 60*b* of the hooking member 60 fixed to the receiving member 32 contacts a lower surface of the projecting portion 10*b*. With this, when lifting the receiving member 32 through the eye bolt 41, the hooking portion 60*b* is hooked to the projecting portion 10*b* and supports the projecting portion 10*b* from below. As a result, the axle box 10 is also lifted together with the receiving member 32 to which the hooking member 60 is fixed. The axle box 10 accommodates the bearing 8 supporting the wheelset 15 and is connected to the bogie frame 3 through the axle box suspension 16. Therefore, the axle box 10 is lifted so as to follow the receiving member 32, and with this, the entire bogie 1 can be lifted.

The bogie 1 configured as above has the following effects.

The attachment hole 32*a* to which the eye bolt 41 used to lift the bogie is attached is formed at the receiving member 32 provided above the axle box 10. With this, when lifting the bogie 1 including the plate spring 9, the lifting rope 50 does not interfere with the wheelset 15 that is a component of the bogie. Further, since the attachment hole 32*a* is formed at the car longitudinal direction end portion of the receiving member 32 supporting the end portion of the plate spring 9, the lifting rope 50 does not interfere with the plate spring 9.

Specifically, the attachment hole 32*a* is formed at the outer wall portion 32*f* located at and above the car longitudinal direction end portion of the bottom wall portion 32*b* of the receiving member 32. With this, the attachment hole 32*a* is provided at a position adequately high with respect to the plate spring 9. Thus, the lifting rope 50 can be suitably prevented from interfering with and being hooked to the plate spring 9.

The eye bolt 41 is attached to the attachment hole 32*a* with the attaching portion 41*a* located higher than the upper surface 9*d* of the plate spring 9. With this, the lifting rope 50 attached to the attaching portion 41*a* can be adequately prevented from interfering with and being hooked to the wheelset 15, the plate spring 9, or the like.

The hooking portion 60*b* of the hooking member 60 fixed to the receiving member 32 is opposed to the projecting portion 10*b* of the axle box 10 from below. When lifting the receiving member 32 to which the eye bolt 41 is attached, the hooking portion 60*b* contacts and is hooked to the projecting portion 10*b*. With this, the hooking portion 60*b* supports the projecting portion 10*b* from below, and thus, the axle box 10 is also lifted together with the receiving member 32. Therefore, even when lifting the bogie 1 in which the axle box 10 and the receiving member 32 are separately formed, the entire bogie 1 can be lifted.

The receiving member 32 includes the bottom wall portion 32*b* and the pair of side wall portions 32*c* projecting upward from both respective car width direction end portions of the bottom wall portion 32*b*. With this, the car longitudinal direction end portion 9*b* of the plate spring 9 is covered with the pair of side wall portions 32*c* from both sides in the car width direction, so that the plate spring 9 can be stably supported even during the lifting of the bogie. Further, in the present embodiment, the cover member 34 covering the car longitudinal direction end portion 9*b* of the plate spring 9 from above is fixed to the receiving member 32. With this, the car longitudinal direction end portion 9*b* of the plate spring 9 is surrounded by the bottom wall portion 32*b*, the pair of side wall portions 32*c*, and the cover member 34, so that the plate spring 9 can be more stably supported during the lifting of the bogie 1.

The eye bolt 41 is detachably attached to the attachment hole 32*a*. With this, when not lifting the bogie (such as when the bogie travels), the eye bolt 41 can be detached from the receiving member 32 and can be stored and managed separately from the bogie 1.

The present invention is not limited to the above embodiment, and modifications, additions, and eliminations may be made within the scope of the present invention. In the above embodiment, the receiving member 32 is formed separately from the axle box 10, and the axle box 10 is lifted together with the receiving member 32 by using the hooking member 60. However, the above embodiment is not limited to this. For example, by integrally forming the receiving member 32 and the axle box 10, the bogie 1 may be lifted without using the hooking member 60.

REFERENCE SIGNS LIST

1 bogie
4 cross beam
8 bearing
9 plate spring
9*b* car longitudinal direction end portion
10 axle box
10*a* bearing accommodating portion
10*b* projecting portion
15 wheelset
30 carbody
32 receiving member
32*a* attachment hole
32*b* bottom wall portion
32*c* side wall portion
32*f* outer wall portion
41 lifting fitting (eye bolt)
41*a* attaching portion
50 bogie lifting rope
60 hooking member
60*a* fixed portion
60*b* hooking portion

The invention claimed is:

1. A railcar bogie comprising:

a cross beam supporting a carbody of a railcar;

an axle box including a bearing accommodating portion accommodating a bearing rotatably supporting a wheelset;

the axle box includes a projecting portion projecting from the bearing accommodating portion outward in the car longitudinal direction;

a plate spring extending in a car longitudinal direction while supporting a car width direction end portion of the cross beam;

a receiving member provided above the axle box and supporting a car longitudinal direction end portion of the plate spring; and a hooking member including a fixed portion and a hooking portion, an upper portion of the fixed portion being fixed to the receiving member, wherein:

an attachment hole is formed at a car longitudinal direction outside portion of the receiving member, a lifting fitting used to lift the bogie being attached to the attachment hole, and the hooking portion is hooked to the projecting portion and is configured to support the projecting portion from below when the receiving member is lifted through the lifting fitting.

2. The railcar bogie according to claim 1, wherein:

the receiving member includes a bottom wall portion supporting a lower surface of the plate spring and an outer wall portion provided at an outside of the bottom wall portion in the car longitudinal direction and located higher than the bottom wall portion; and the attachment hole is formed at the outer wall portion.

3. The railcar bogie according to claim 2, wherein the receiving member further includes a pair of side wall portions projecting upward from both respective car width direction ends of the bottom wall portion.

4. The railcar bogie according to claim 2, wherein:

the lifting fitting is an eye bolt including an annular attaching portion to which a bogie lifting rope is attached; and the eye bolt is attached to the attachment hole with the attaching portion located higher than the plate spring.

5. The railcar bogie according to claim 4, wherein the eye bolt is detachably attached to the attachment hole.

6. The railcar bogie according to claim 1, wherein:

the lifting fitting is an eye bolt including an annular attaching portion to which a bogie lifting rope is attached; and the eye bolt is attached to the attachment hole with the attaching portion located higher than the plate spring.

7. The railcar bogie according to claim 6, wherein the eye bolt is detachably attached to the attachment hole.

8. The railcar bogie according to claim 1, wherein the attachment hole is formed along a vertical direction.

9. The railcar bogie according to claim 1, wherein the lifting fitting includes an attaching portion to which a bogie lifting rope is attached, and wherein the attaching portion of the lifting fitting is located at a position higher than an upper surface of the plate spring.

10. The railcar bogie according to claim 1, wherein the lifting fitting includes an attaching portion to which a bogie lifting rope is attached, and wherein the attaching portion of the lifting fitting is located at a position higher than an upper surface of the plate spring.

11. A railcar bogie comprising:

a cross beam supporting a carbody of a railcar;

an axle box including a bearing accommodating portion accommodating a bearing rotatably supporting a wheelset;

a plate spring extending in a car longitudinal direction while supporting a car width direction end portion of the cross beam; and a receiving member provided above the axle box and supporting a car longitudinal direction end portion of the plate spring, an attachment hole being formed at a car longitudinal direction outside portion of the receiving member, a lifting fitting used to lift the bogie being attached to the attachment hole, wherein the receiving member includes a bottom wall portion supporting a lower surface of the plate spring and a pair of side wall portions projecting upward from both respective car width direction ends of the bottom wall portion, and an outer wall portion provided at an outside of the bottom wall portion in the car longitudinal direction and located higher than the bottom wall portion, and wherein the attachment hole is formed at the outer wall portion.

12. The railcar bogie according to claim 11, further comprising a hooking member including a fixed portion and a hooking portion, the fixed portion being fixed to the receiving member, the hooking portion being provided lower than the fixed portion, wherein:

the axle box includes a projecting portion projecting from the bearing accommodating portion outward in the car longitudinal direction; and when the receiving member is lifted through the lifting fitting, the hooking portion is opposed to the projecting portion from below so as to support the projecting portion.

13. The railcar bogie according to claim 12, wherein:

the lifting fitting is an eye bolt including an annular attaching portion to which a bogie lifting rope is attached; and the eye bolt is attached to the attachment hole with the attaching portion located higher than the plate spring.

14. The railcar bogie according to claim 13, wherein the eye bolt is detachably attached to the attachment hole.

15. The railcar bogie according to claim 11, wherein:

the lifting fitting is an eye bolt including an annular attaching portion to which a bogie lifting rope is attached; and the eye bolt is attached to the attachment hole with the attaching portion located higher than the plate spring.

16. The railcar bogie according to claim 15, wherein the eye bolt is detachably attached to the attachment hole.

17. The railcar bogie according to claim 11, wherein the attachment hole is formed along a vertical direction.

* * * * *